US011918154B2

(12) United States Patent
van der Linde

(10) Patent No.: US 11,918,154 B2
(45) Date of Patent: Mar. 5, 2024

(54) PORTABLE RESTROOM SYSTEM

(71) Applicant: Peter van der Linde, Charlottesville, VA (US)

(72) Inventor: Peter van der Linde, Charlottesville, VA (US)

( * ) Notice: Subject to any disclaimer, the term of this patent is extended or adjusted under 35 U.S.C. 154(b) by 109 days.

(21) Appl. No.: 17/459,145

(22) Filed: Aug. 27, 2021

(65) Prior Publication Data

US 2023/0061537 A1 Mar. 2, 2023

(51) Int. Cl.
*A47K 11/02* (2006.01)
*E04H 1/12* (2006.01)

(52) U.S. Cl.
CPC ..... *A47K 11/02* (2013.01); *E04H 1/1216* (2013.01)

(58) Field of Classification Search
CPC ..... E04H 1/1216; A47K 11/02; A47K 11/04
See application file for complete search history.

(56) References Cited

U.S. PATENT DOCUMENTS 3,959,829 A * 6/1976 Nordgren ..... A47K 11/02 4/111.5
4,305,164 A * 12/1981 Sargent ..... E04H 1/1216 428/116
6,115,971 A 9/2000 Loebertmann et al.
6,615,414 B2 * 9/2003 Miller ..... E03D 7/00 4/476
7,299,511 B2 * 11/2007 Quan ..... B64D 11/02 4/664
9,060,652 B2 * 6/2015 Bikker ..... E04H 1/1216
9,303,420 B2 4/2016 Van der Linde
2003/0121093 A1 7/2003 Braxton
2008/0209625 A1 * 9/2008 Hampel ..... E04H 1/1216 4/479
2010/0058518 A1 * 3/2010 Bourgeois ..... E04H 1/1216 4/144.1
2012/0102635 A1 5/2012 Cheng
2014/0325921 A1 * 11/2014 Van Overbeek ..... E04B 1/344 52/79.5

FOREIGN PATENT DOCUMENTS

CN 107939083 4/2018
WO WO-2019137592 A1 * 7/2019 ..... E03D 13/00

OTHER PUBLICATIONS

International Search Report for International Patent Application No. PCT/US22/41670, dated Dec. 8, 2022, 2 pages.
Written Opinion of the International Searching Authority for International Patent Application No. PCT/US22/41670, dated Dec. 8, 2022, 4 pages.

* cited by examiner

*Primary Examiner* — Janie M Loeppke
(74) *Attorney, Agent, or Firm* — Andrew D. Wright; Calderon Safran & Cole, P.C

(57) ABSTRACT

A portable restroom system includes plural individual restrooms connected as a pod structure and supported by a chassis. Each restroom includes: a lockable door that opens to outside the pod structure; and a tank having a toilet with a toilet opening, a urinal with a urinal opening, a cleaning port, and two vent holes, all as part of a unitary tank body that defines an interior volume.

20 Claims, 11 Drawing Sheets

PORTABLE RESTROOM SYSTEM

FIELD OF THE INVENTION

The present invention generally relates to portable restrooms and, more particularly, to portable structures containing plural restroom units.

BACKGROUND

Portable restrooms, sometimes referred to as port-a-johns, rest stations, etc., are commonly rented and used for special events such as parties, festivals or concerts, construction sites, and other locations where people gather temporarily. Single unit portable restrooms are common. Multi-unit portable restrooms also exist and are typically permanently installed on trailers with wheels. Such multi-unit portable restrooms are typically equipped with separate vanities, toilets, showers, plumbing for running water, electrical wiring for lighting, etc., for each individual unit, in an effort to provide a conventional home-like bathroom on wheels. However, such multi-unit portable restrooms are expensive to procure and maintain since they involve many extra parts such as wheels, wheel bearings, wheel axles, water pumps, etc.

Single unit portable restrooms, such as the conventional port-a-john, are a much less expensive alternative to the larger, trailer-based rest stations. However, there is great difficulty and expense in servicing the single unit portable restrooms during extended deployments to a site.

SUMMARY

In a first aspect of the invention, there is a portable restroom system that includes plural individual restrooms connected as a pod structure and supported by a chassis, wherein each restroom comprises: a lockable door that opens to outside the pod structure; and a tank having a toilet with a toilet opening, a urinal with a urinal opening, a cleaning port, and two vent holes, all as part of a unitary tank body that defines an interior volume.

In embodiments, the cleaning port is at a top surface of the tank body between the toilet and the urinal; and a bottom, interior surface of the tank body is sloped toward a location that is vertically aligned with and underneath the cleaning port. The cleaning port may have an inside diameter that is greater than or equal to 3.0 inches.

In an implementation, the chassis is at a bottom of the pod structure and comprises: fork tubes configured to receive forks of a forklift; and skid rails configured for skidding the pod structure. The fork tubes may extend perpendicular to the skid rails. The fork tubes may extend from a first side of the pod structure to a second side of the pod structure, and the skid rails may extend from a third side of the pod structure to a fourth side of the pod structure.

In embodiments, the plural individual restrooms consist of four rooms arranged in a square-like shape of the pod structure when viewed from a top-down view. The system may further comprise: a chase extending vertically in a center of the pod structure; and plural vent tubes comprising a respective vent tube connected to each respective tank extending through the chase. The system may further comprise a roof that covers each of the four rooms and the chase, the roof comprising plural holes through which the plural vent tubes extend to outside the pod structure. In embodiments, the two vent holes of each tank comprise a first vent hole at a first corner of the tank and a second vent hole at a second corner of the tank, two of the tanks in a two of the four rooms have their first vent hole connected to respective ones of the vent tubes in the chase, and two other ones of the tanks in two other ones of the four rooms have their second vent hole connected to respective ones of the vent tubes in the chase. The chase may be defined by portions of interior walls that separate the four rooms.

In implementations, two of the four rooms have their door on a first side of the pod structure, and two other ones of the four rooms have their door on a second side of the pod structure. In embodiments, the doors of the two of the four rooms open outward with a right-hand swing, and the doors of the two other ones of the four rooms open outward with a left-hand swing. The system may further comprise a first floor element that defines a floor of the two of the four rooms, and a second floor element that defines a floor of the two other ones of the four rooms. The chassis may connect the first floor element and the second floor element. The system may further comprise: a first external wall on a third side of the pod structure; a second external wall on a fourth side of the pod structure; and a single roof connected to each of the first external wall and the second external wall, wherein the single roof covers the four rooms.

In embodiments, the pod structure is devoid of wheels for movement. In embodiments, the pod structure is devoid of water pumps.

In another aspect of the invention, there is a portable restroom system that includes: a pod structure comprising four restrooms supported by a chassis; and a chase extending vertically in the pod structure between the four restrooms. Each restroom comprises: a lockable door that opens to outside the pod structure; and a tank having a unitary tank body that defines an interior volume, a toilet that opens to the interior volume, a urinal that opens to the interior volume, a cleaning port that opens to the interior volume, and at least one vent hole that opens to the interior volume and that is in the chase.

In embodiments, for each respective tank, the cleaning port is at a top surface of the tank body between the toilet and the urinal. In embodiments, for each respective tank, a bottom, interior surface of the tank body is sloped toward a location that is vertically aligned with and underneath the cleaning port. In embodiments, the chassis is at a bottom of the pod structure, the chassis comprises fork tubes configured to receive forks of a forklift, and the chassis comprises skid rails configured for skidding the pod structure such that the pod structure is devoid of wheels for movement.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION

Figure 1:
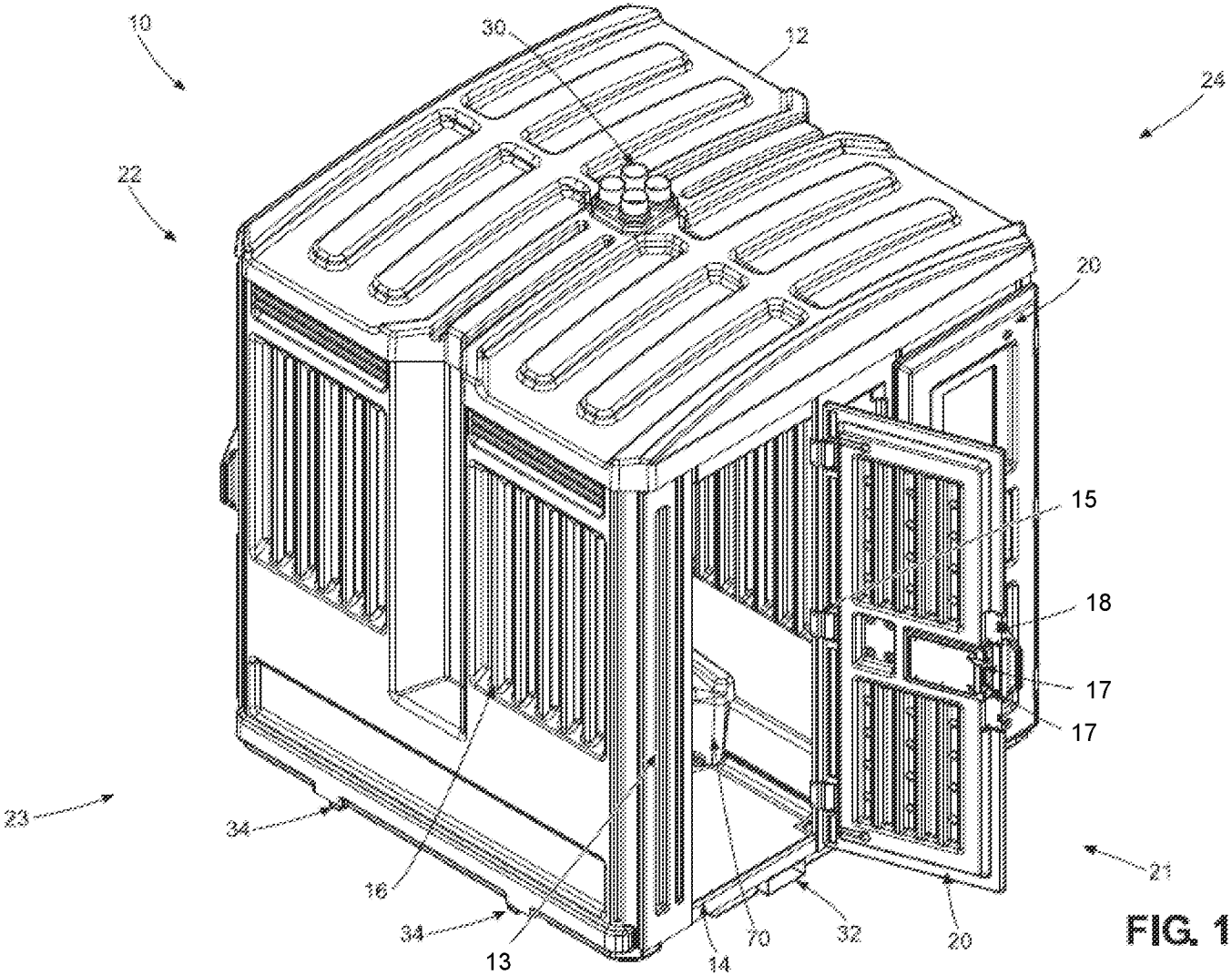
FIG. 1 shows a perspective view of a portable restroom system in accordance with aspects of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention generally relates to portable restrooms and, more particularly, to portable structures containing plural restroom units. According to aspects of the invention, a portable restroom system includes plural individual restroom units that are constructed together as a pod in a manner such that the plural individual restroom units share wall elements, a top element, and floor elements. Each of the individual restroom units has its own door that opens externally, such that each of the individual restroom units defines a private space that is accessible by individuals from outside the portable restroom system.

Implementations of the portable restroom system provide advantages over high-end, trailer-based rest stations. Implementations of the inventive portable restroom system are less expensive to construct and maintain compared to high-end, trailer-based rest stations. This is because implementations of the inventive portable restroom system do not require additional equipment such as vanities, plumbing for running water, wiring for electricity, water pumps, wheels, axles, etc. As a result, implementations of the inventive portable restroom system may be made at a lower cost and maintained at a lower cost compared to compared to high-end, trailer-based rest stations and, thus, rented at a lower cost to customers.

Implementations of the portable restroom system also provide advantages over individual port-a-johns. A single port-a-john that is rented out for a month requires a weekly on-site (at the rental location) service visit for cleaning. The service visits are costly for the owner of the port-a-john who must pay for personnel and equipment to perform the service visits. Due to a number of factors, the cleaning of the port-a-john during such on-site service visits is often poorly done, which leaves the customer rightfully upset. As described herein, implementations of the inventive portable restroom system can be cleaned much more efficiently compared to individual port-a-johns. This reduces operational costs for the owner who must provide clean units to the customer. As described herein, implementations of the inventive portable restroom system are faster to load and unload (e.g., during delivery to, and pick up from, a rental site) when compared to plural individual port-a-johns, and require fewer on-site service visits compared to individual port-a-johns. This also reduces operational costs for the owner who must pay personnel to perform these duties. As described herein, implementations of the inventive portable restroom system improve goodwill between the owner and a customer by providing pristine, clean individual units for use at intervals defined by the customer, with no question as to whether each unit was properly cleaned during an on-site service visit. As a result, the owner is more likely to get repeat business from the customer.

Figure 2:
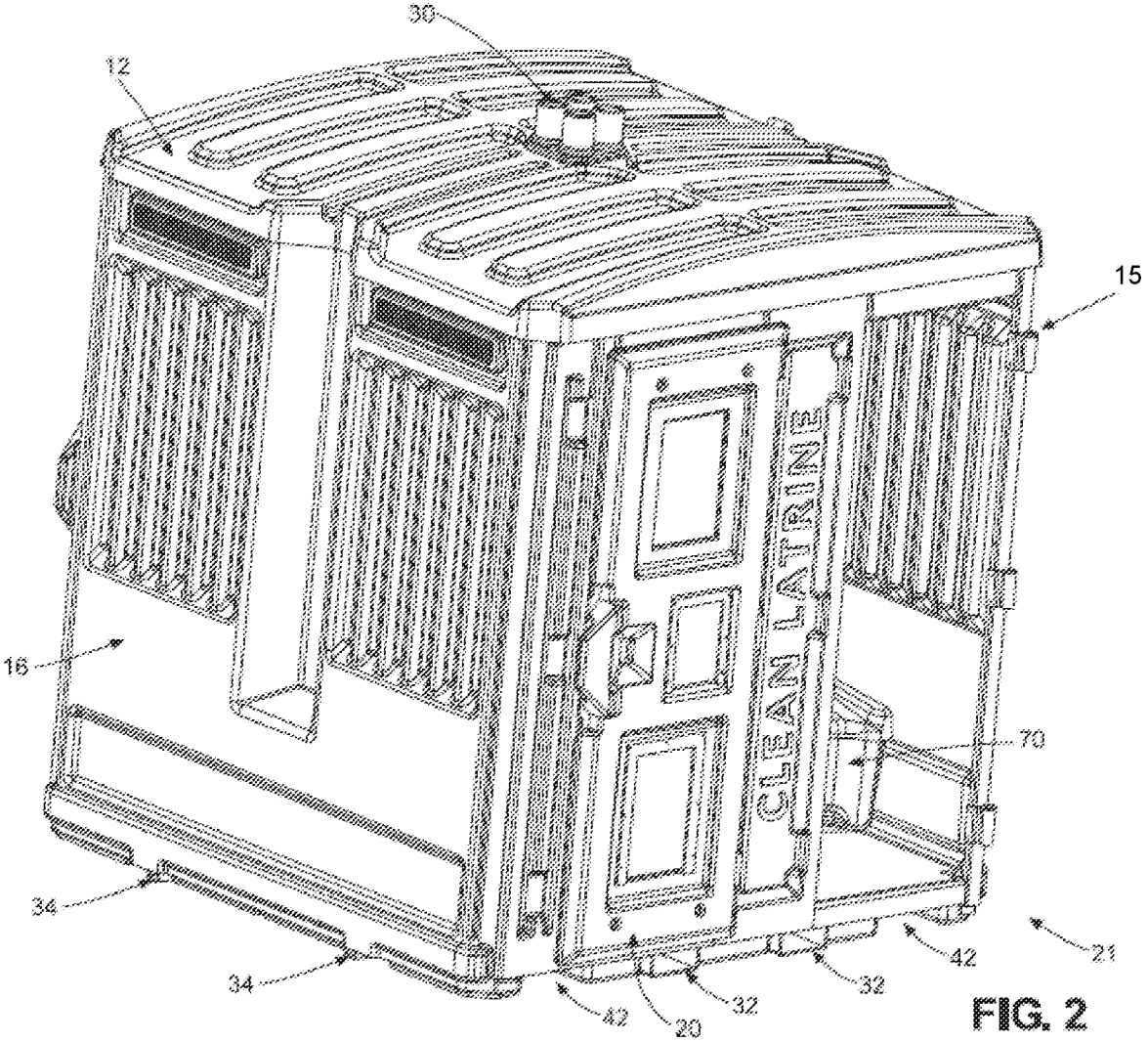
FIG. 2 shows another perspective view of the portable restroom system in accordance with aspects of the invention.

FIGS. 1 and 2 show perspective views of a portable restroom system 10 in accordance with aspects of the invention. An exemplary portable restroom system 10 is shown and described herein with four individual restroom units; however, implementations of the invention are not limited to four individual restroom units, and other numbers of individual restroom units greater than four may be used.

According to aspects of the invention, the portable restroom system 10 includes a roof 12, floor elements 14, exterior wall panels 16, interior wall panels, and doors 20 that are connected in a pod structure to provide four individual restroom units each having a respective private space within the pod structure and an entrance separate from the entrances to the other units. In embodiments, two entrances to two of the four restroom units are at a first side 21 of the portable restroom system 10, and two entrances to the other two of the four restroom units are at a second side 22 of the portable restroom system 10, the second side 22 being opposite the first side 21. In embodiments, a third side 23 of the portable restroom system 10 includes a side wall panel 16 extending between the first side 21 and the second side 22, and a fourth side 23 of the portable restroom system 10 includes a side wall panel extending between the first side 21 and the second side 22, the fourth side 24 being opposite the third side 23.

FIG. 1 shows the portable restroom system 10 with one of the doors 20 on the first side 21 open and another one of the doors 20 on the first side 21 closed. FIG. 2 shows the portable restroom system 10 with one of the doors 20 on the first side 21 closed and another one of the doors 20 on the first side 21 having been removed.

Also shown in FIGS. 1 and 2 are vent tubes 30 extending through the roof 12, each respective vent tube configured to vent a tank of a respective one of the four restroom units. Further shown in FIGS. 1 and 2 are fork tubes 32 and skid rails 34 that are part of a chassis as described herein. Further shown in FIGS. 1 and 2 are door wall 13, door hinge bearing 15, door latch 17, and door hasp panel 18.

Figure 3:
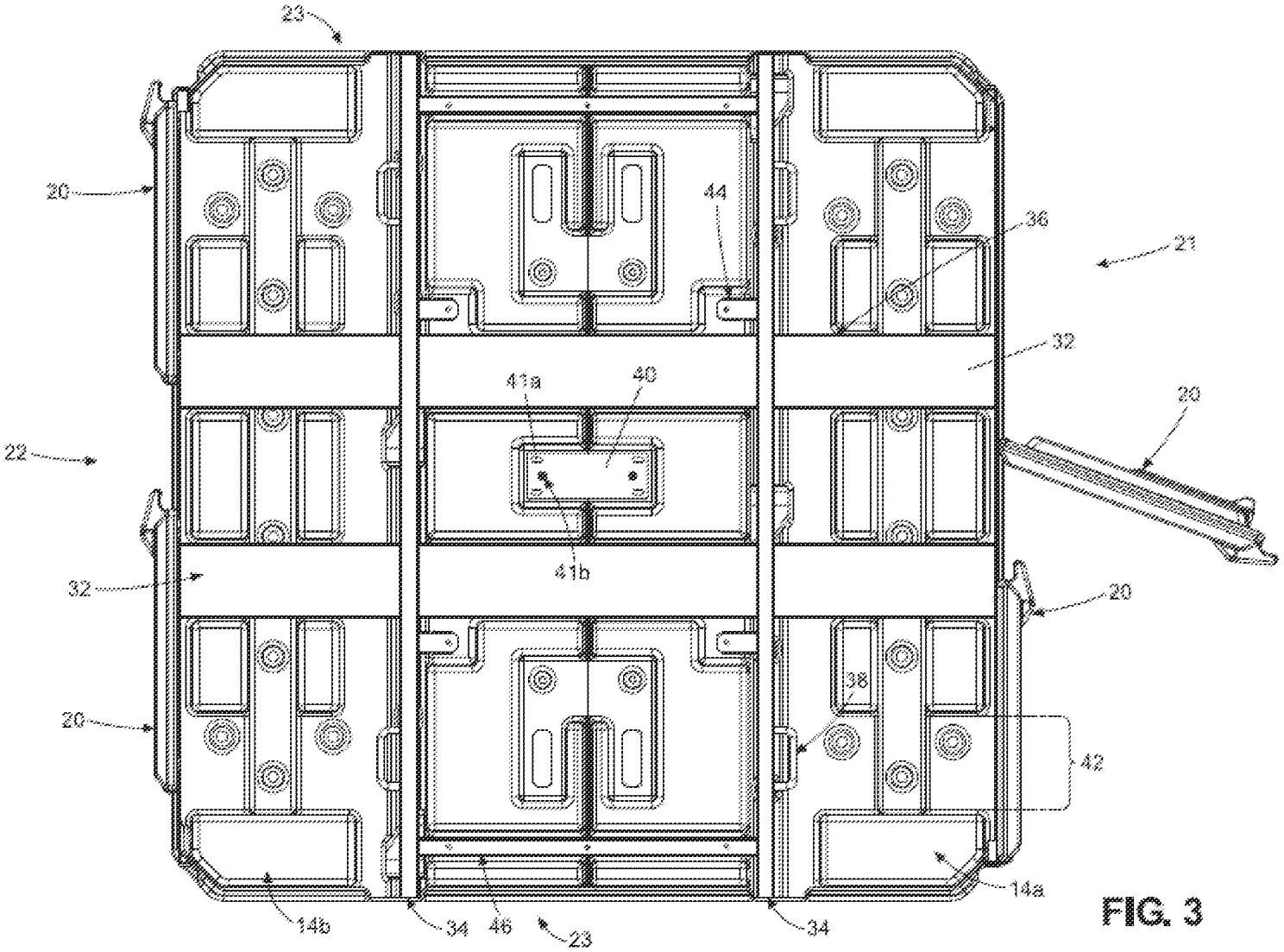
FIG. 3 shows a bottom view of the portable restroom system in accordance with aspects of the invention.

FIG. 3 shows a bottom view of the portable restroom system 10 in accordance with aspects of the invention. In embodiments, the portable restroom system 10 includes a chassis 36 connected to the floor elements 14*a* and 14*b*, the chassis 36 including the fork tubes 32 and skid rails 34. The chassis 36 is made of an appropriate material having sufficient strength and rigidity to provide structural support to the connected elements of the portable restroom system 10, particularly during transportation of the portable restroom system 10 (e.g., on a flatbed truck) and lifting and lowering of the portable restroom system 10 (e.g., onto and off of a flatbed truck). In one example, the chassis 36 is metal, preferably steel.

In embodiments, the fork tubes 32 are perpendicular to the skid rails 34. As shown in FIG. 3, the fork tubes 32 extend across the bottom of the portable restroom system 10 from one side (e.g., first side 21) to an opposite side (e.g., second side 22), and the skid rails 34 extend across the bottom of the portable restroom system 10 from another one side (e.g., third side 23) to another opposite side (e.g., fourth side 24). In a particular embodiment, each of the fork tubes 32 passes through each of the skid rails 34, such that each of the fork tubes 32 defines a fork tube opening that extends continuously from one side of the portable restroom system 10 to an opposite side of the portable restroom system 10.

According to aspects of the invention, the fork tubes 32 are sized and arranged to receive forks of a forklift such that the forklift may be used to lift and transport the portable restroom system 10. In this regard, the fork tubes 32 may be designed such that the fork tube opening of each fork tube is sized and shaped to receive a fork of a forklift. As but one example, each of the fork tubes 32 may be sized to define a fork tube opening that is 3 inches high and 8 inches wide. By using a forklift, moving the portable restroom system 10 one time onto (or off of) a vehicle (e.g., flatbed truck or trailer) is a faster way to deliver four restroom units than moving four individual port-a-johns onto (or off of) the same vehicle.

In embodiments, the skid rails 34 are adapted to permit movement of the portable restroom system 10 by sliding on the skid rails 34, as is commonly seen with roll-off containers, dumpsters, etc. In embodiments, the skid rails 34 are sized and spaced apart from one another to conform to industry standards, such as 34 inch spacing, although any desired size and spacing may be used within the scope of the invention. In one example, the skid rails 34 are spaced apart from one another by a dimension that accommodates industry standard roll off rails, such as a spacing of 34.5 to 35.5 inches between the skid rails 34. By using the skid rails 34 as skids for sliding the portable restroom system 10 across surfaces (e.g., a truck bed, the ground, a concrete floor, etc.), the portable restroom system 10 may be devoid of wheels and axles. In embodiments, the skid rails 34 are integrally connected to the fork tubes 32, e.g., by welding.

Still referring to FIG. 3, in embodiments the chassis 36 includes at least one anchor structure 38. In a preferred embodiment, the chassis 36 includes four anchor structures 38 each comprising a U-shaped element extending outward from one of the skid rails 34. In use, the anchor structures 38 provide attachment points for chains or tie-down straps that secure the portable restroom system 10 to a vehicle (e.g., a flatbed truck, trailer, roll-off, etc.) while the portable restroom system 10 is being transported from one location to another. In embodiments, the anchor structures 38 are integrally connected to the skid rails 34, e.g., by welding.

With continued reference to FIG. 3, in embodiments the portable restroom system 10 includes two floor elements 14*a* and 14*b*. Implementations of the invention are not limited to only two floor elements, and other numbers of floor elements may be used. For example, a single floor element may be used, or more than two floor elements may be used. When plural floor elements are used, one or more brackets may be used to connect plural ones of the floor elements together. For example, as shown in FIG. 3, bracket 40 is fixedly connected to both floor elements 14*a* and 14*b* and, thus, provides additional structural support to the portable restroom system 10. The bracket 40 may have holes, such as at 41*a* and 41*b*, configured to receive mechanical fasteners that secure the floor elements 14*a* and 14*b* to the bracket 40. In embodiments, floor elements 14*a* and 14*b* comprise openings 42 aligned with the anchor structures 38 so that a user can access the anchor structures 38 via the openings 42 when the portable restroom system 10 is standing upright on a surface of a vehicle (e.g., a flatbed truck, trailer, etc.). In this manner, a user may connect a chain or tie-down strap to, or disconnect a chain or tie-down strap from, an anchor 38 via an opening 42.

The chassis 36 may include one or more attachment elements that are structured and arranged for connecting the chassis 36 to the floor elements 14*a* and 14*b*. In the example shown in FIG. 3, the chassis 36 includes four flanges 44 and two crossbars 46, each of which may be connected to one or both of the floor elements 14*a* and 14*b* using fasteners such as screws, bolts, rivets, etc. Other numbers and configurations of attachment elements may be used in implementations. In embodiments, the attachment elements are integrally connected to the skid rails 34, e.g., by welding.

Figure 4:
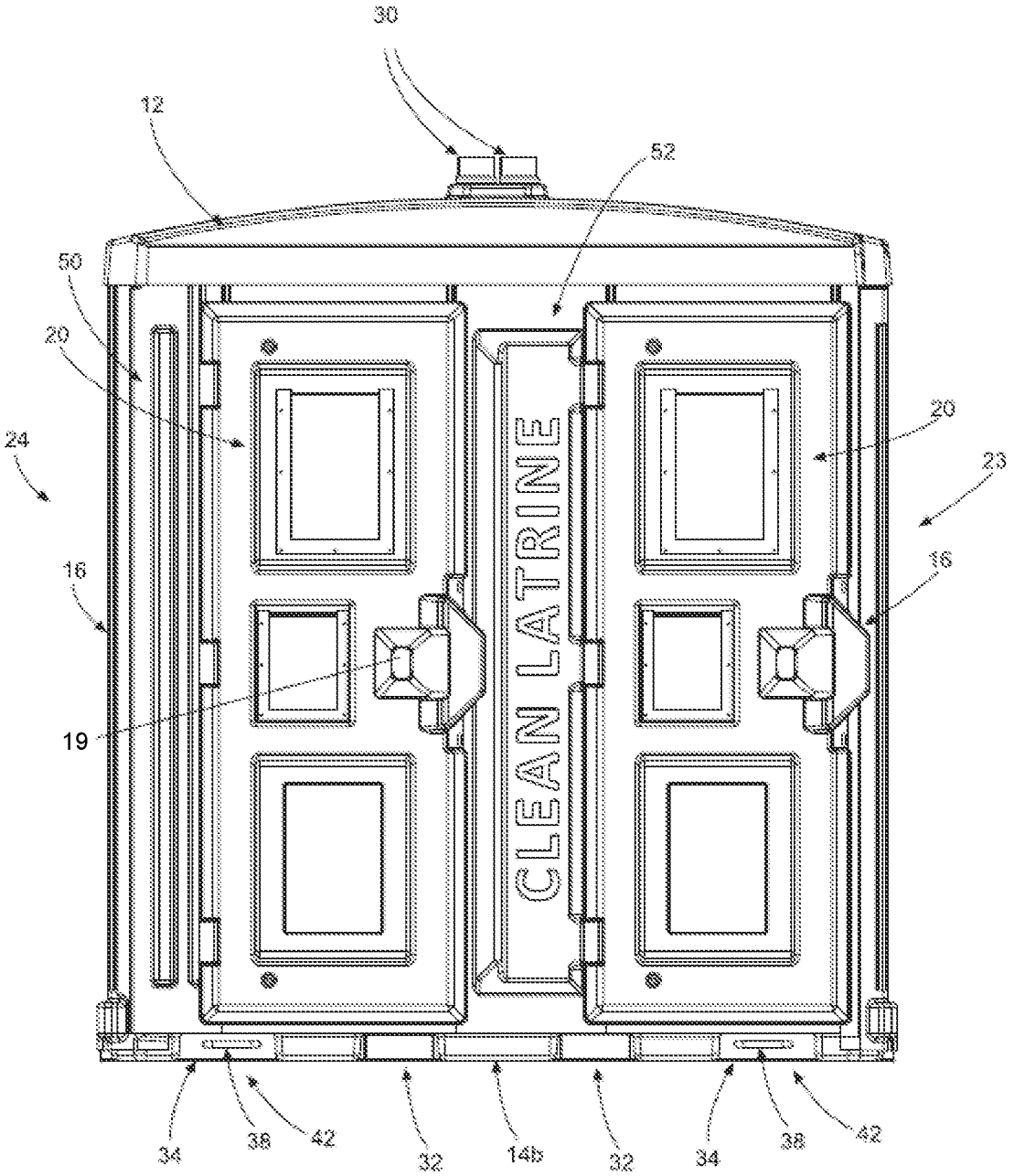
FIG. 4 shows a side view of the portable restroom system in accordance with aspects of the invention.

FIG. 4 shows a side view of the portable restroom system 10, looking toward the second side. As shown in FIG. 4, the openings 42 in the floor element 14*b* expose a portion of the skid rail 34 and the anchor structure 38 from the side of the portable restroom system 10, such that the anchor structures 38 are accessible from the sides of the portable restroom system 10 when the portable restroom system 10 is standing upright on a flat surface. As further shown in FIG. 4, in embodiments, the bottommost surfaces of the floor element 14*a* are essentially flush with the bottommost surfaces of the skid rails 34, such that the bottommost surfaces of the floor element 14*a* and the bottommost surfaces of the skid rails 34 combine to form a bottom surface of the portable restroom system 10.

Also shown in FIG. 4 are exterior wall panels 16 on the third side 23 and fourth side 24. In embodiments, the exterior wall panels 16 are connected to, and extend between, the floor elements 14*a*, 14*b* and the roof 12. Also shown in FIG. 4 is door handle 19.

Also shown in FIG. 4 are a door wall edge panel 50 and a door wall center panel 52. In embodiments, the door wall edge panel 50 and the door wall center panel 52 are connected to, and extend vertically between, the floor element 14*b* and the roof 12. In embodiments, one door 20 on the second side is hingedly connected to the door wall edge panel 50, and another door 20 on the second side is hingedly connected to the door wall center panel 52. Although not shown in FIG. 4, a similar arrangement of door wall edge panel and door wall center panel may be provided on the first side of the portable restroom system 10.

Figure 5:
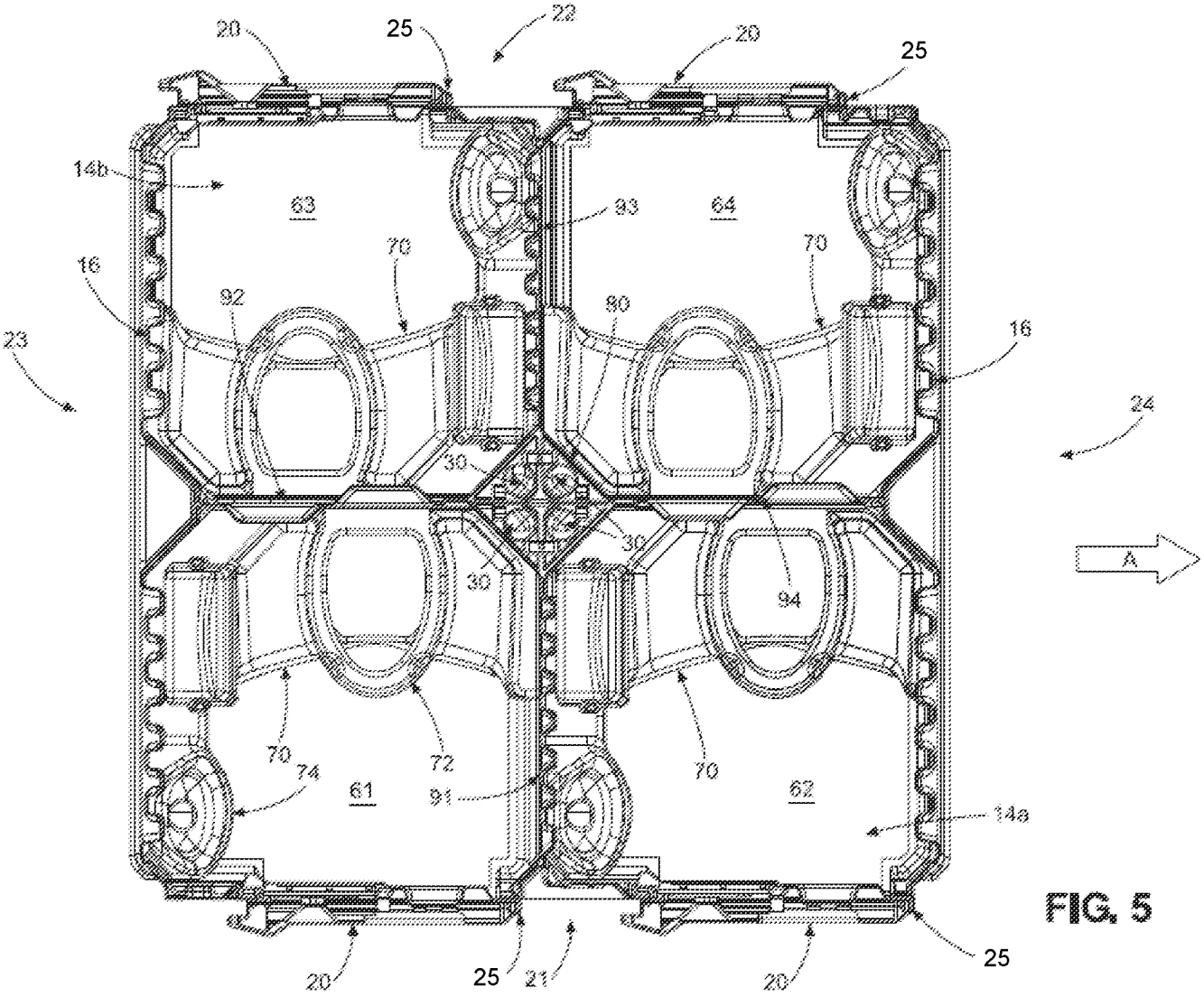
FIG. 5 shows a plan, cutaway view of the portable restroom system in accordance with aspects of the invention.

FIG. 5 shows a plan, cutaway view of the portable restroom system 10 in accordance with aspects of the invention. As shown in FIG. 5, the exterior wall panels 16 are at the third side 23 and the fourth side 24, and doors 20 and door wall center panels are at the first side 21 and the second side 22. According to aspects of the invention, interior walls 91-94 extend between the first side 21 and the second side 22, and between the third side 23 and the fourth side 24. The interior walls define four private rooms 61, 62, 63, 64 inside the portable restroom system 10. In embodiments, each room 61-64 includes a tank 70 that includes a toilet 72 and a urinal 74. In embodiments, each room is bounded at its lower end by a portion of one of the floor elements 14*a*, 14*b*, which form a floor that a user stands on when the user is inside one of the rooms. Each room 61-64 may optionally include a toilet paper holder connected to one of the interior walls.

As shown in FIG. 5, in embodiments the interior walls combine to form a chase 80 that is centrally located in the portable restroom system 10 between the rooms 61-64. As shown in FIG. 5, the vent tubes 30 are housed in the chase 80, such that the vent tubes 30 are not visible to users inside any of the rooms 61-64. Also shown in FIG. 5 is hinge 25.

In embodiments, the portable restroom system 10 is constructed such that the doors 20 on the first side 21 each have a same swing direction, and the doors 20 on the second side 22 each have a swing direction that is opposite that of the doors on the first side 21. For example, as shown in FIG. 5, the doors 20 on the first side 21 each have a left-hand swing, and the doors 20 on the second side 22 each have a right-hand swing. In this manner, when the portable restroom system 10 is on a vehicle traveling on the direction shown by arrow A in FIG. 5, the wind will tend to keep all the doors 20 closed rather than flipping any of the doors open. Using identical doors 20 on each of the first side 21 and second side 22 facilitates hanging the doors in this manner while also minimizing production costs since only a single shape door need be fabricated for all four openings.

Figure 6:
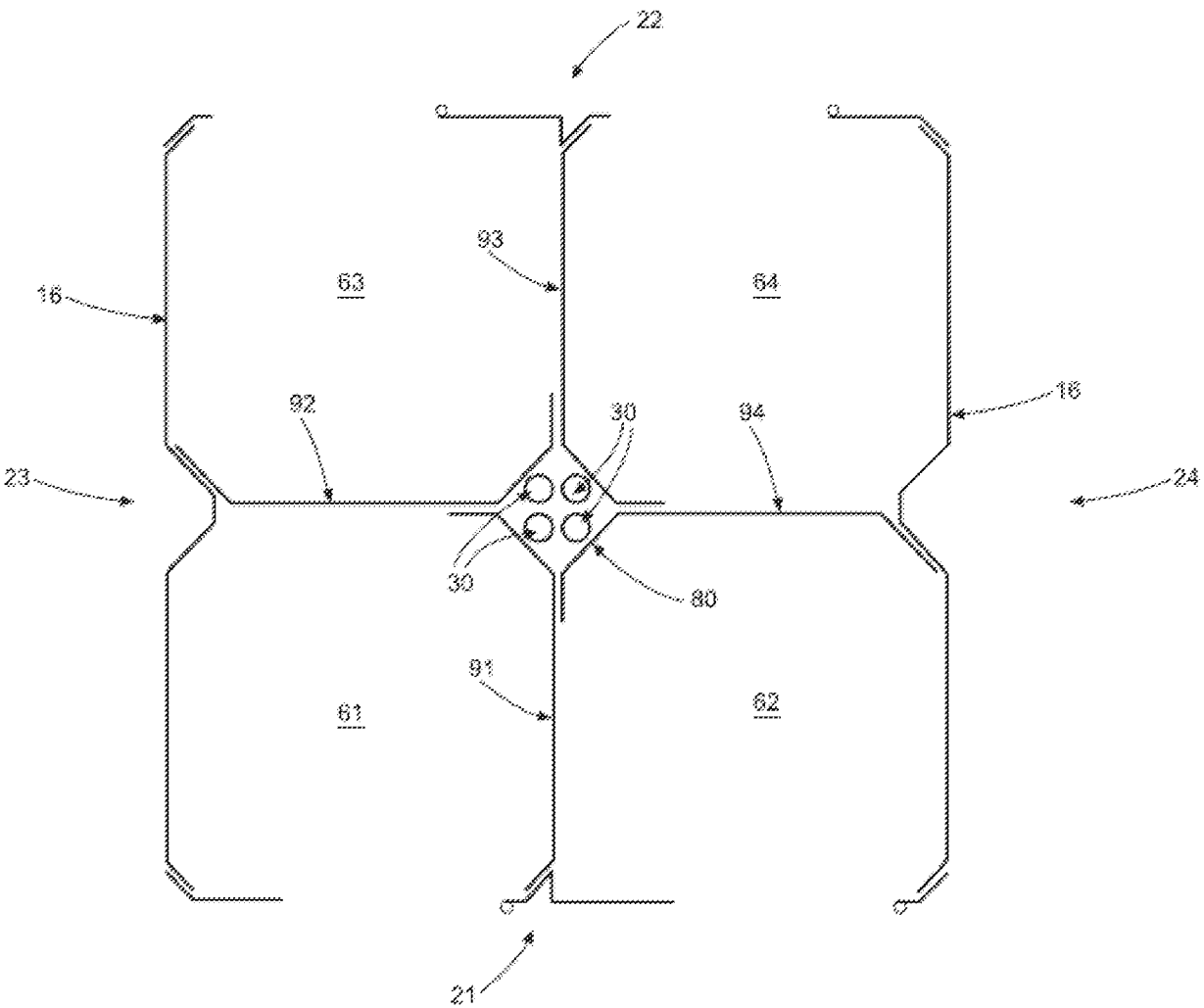
FIG. 6 shows diagrammatic view of an exemplary arrangement of wall elements of the portable restroom system in accordance with aspects of the invention.

FIG. 6 shows a diagrammatic plan view of an exemplary arrangement of wall elements of the portable restroom system 10 in accordance with aspects of the invention. FIG. 6 shows a view from the same top-down perspective as that of FIG. 5, with the portable restroom system 10 oriented with its sides 21-24 as shown in the figures. In embodiments, the interior walls described at FIG. 5 include a first interior wall 91, a second interior wall 92, and third interior wall 93, and a fourth interior wall 94, as shown in FIG. 6.

In embodiments, the first interior wall 91 is connected to the door wall center panel at the first side 21, the second interior wall 92, and the fourth interior wall 94. In this manner, the first interior wall 91 defines a wall between the first room 61 and the second room 62. In embodiments, the connections are made at overlapping portions of the walls and may be made using adhesive and/or mechanical fasteners such as pop-rivets. Gaps are shown between the overlapping portions of the walls in FIG. 6 for illustration, but these overlapping portions contact one another when connected.

In embodiments, the second interior wall 92 is connected to one of the exterior wall panels 16 at the third side 23, the first interior wall 91, and the third interior wall 93. In this manner, the second interior wall 92 defines a wall between the first room 61 and the third room 63. In embodiments, the connections are made at overlapping portions of the walls and may be made using adhesive and/or mechanical fasteners such as pop-rivets. Gaps are shown between the overlapping portions of the walls in FIG. 6 for illustration, but these overlapping portions contact one another when connected.

In embodiments, the third interior wall 93 is connected to the door wall center panel at the second side 22, the second interior wall 92, and the fourth interior wall 94. In this manner, the third interior wall 93 defines a wall between the third room 63 and the fourth room 64. In embodiments, the connections are made at overlapping portions of the walls and may be made using adhesive and/or mechanical fasteners such as pop-rivets. Gaps are shown between the overlapping portions of the walls in FIG. 6 for illustration, but these overlapping portions contact one another when connected.

In embodiments, the fourth interior wall 94 is connected to one of the exterior wall panels 16 at the fourth side 24, the first interior wall 91, and the third interior wall 93. In this manner, the fourth interior wall 94 defines a wall between the second room 62 and the fourth room 64. In embodiments, the connections are made at overlapping portions of the walls and may be made using adhesive and/or mechanical fasteners such as pop-rivets. Gaps are shown between the overlapping portions of the walls in FIG. 6 for illustration, but these overlapping portions contact one another when connected.

Figure 12A:
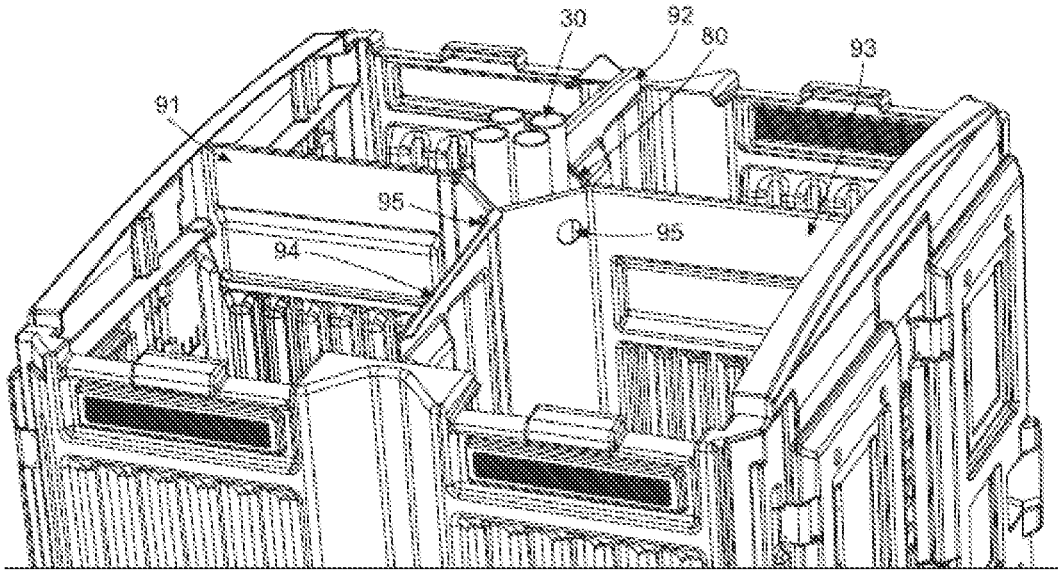
FIGS. 12A and 12B show partial perspective views of the interior of the portable restroom system in accordance with aspects of the invention.
Figure 12B:
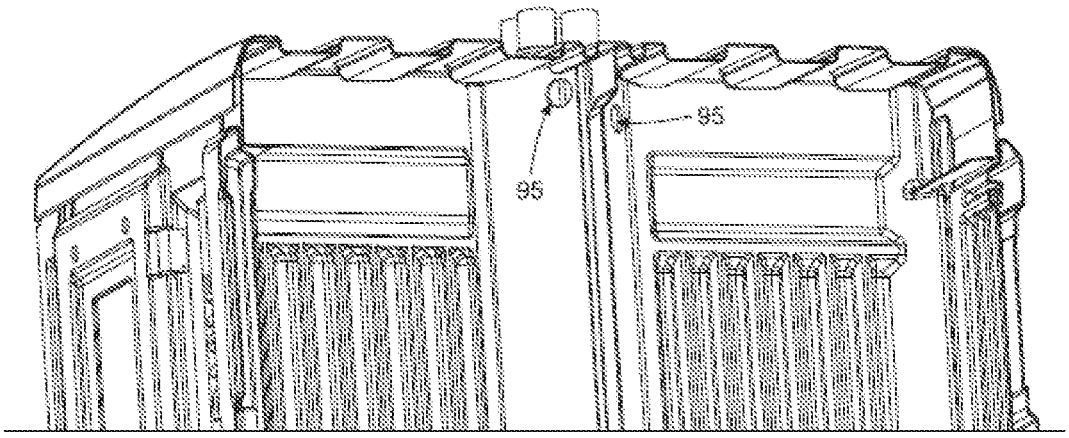

As shown in FIG. 6, in embodiments respective portions of the interior walls 91-94 define the vertical chase 80 that hides the vent tubes 30 from the view of users inside the rooms 61-64. In one exemplary implementation, a portable music source is placed in one of the four rooms. For example, a wireless (e.g., Bluetooth) speaker may be placed in one of the rooms to provide music to all four rooms. The interior walls between rooms, and the overlapping portions of the interior walls at the chase 80, transmit the music played in one room to the other three rooms. In an exemplary embodiment shown in FIGS. 12A and 12B, each of the interior walls 91-94 has at least one communication port 95 that is configured to communicate music and/or conditioned air (e.g., HVAC air) between the rooms 61-64 via the chase 80. (The roof 12 is not shown in FIG. 12A for clarity of illustration.) In the example shown in FIGS. 12A and 12B, the communication port 95 comprises a hole in the portion of the interior wall that defines the chase 80, with each of the each of the interior walls 91-94 having the communication port 95 arranged in this manner. As shown in FIGS. 12A and 12B, in embodiments the chase 80 has an interior volume that surrounds the vent tubes 30, and each of the communication ports 95 provides a communication path (e.g., an airflow path) between one of the respective rooms 61-64 and the interior volume defined by the chase 80. In this manner, music that is played in one of the rooms (e.g., room 61) is communicated to the other rooms (e.g., rooms 62-64) via the communication ports 95 and the interior volume defined by the chase 80. Similarly, conditioned air that is provided in one of the rooms (e.g., room 61) is communicated to the other rooms (e.g., rooms 62-64) via the communication ports 95 and the interior volume defined by the chase 80.

Figure 7A:
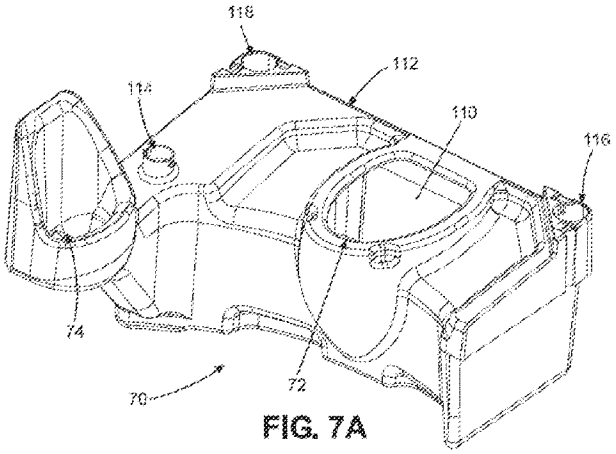
FIGS. 7A-D show views of a tank of the portable restroom system in accordance with aspects of the invention.
Figure 7D:
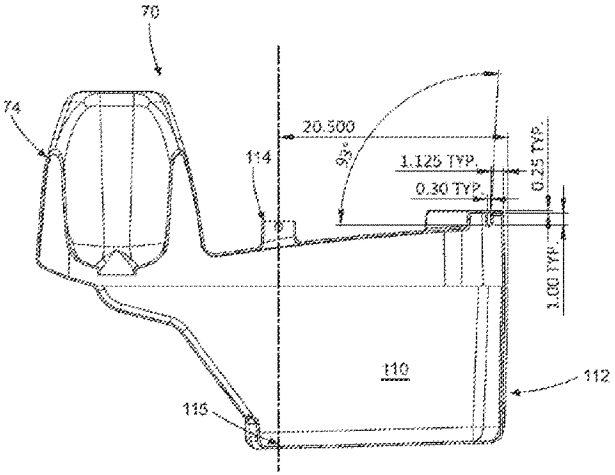
Figure 7B:
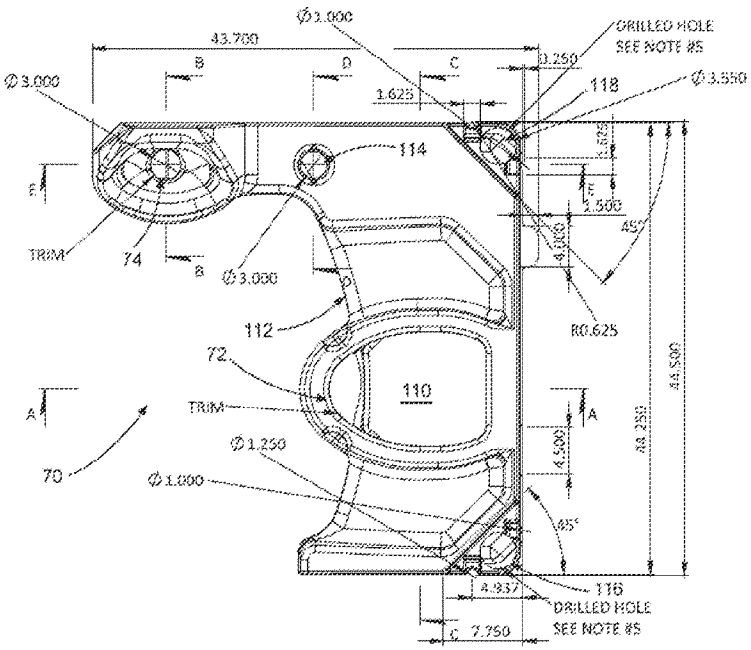
Figure 7C:
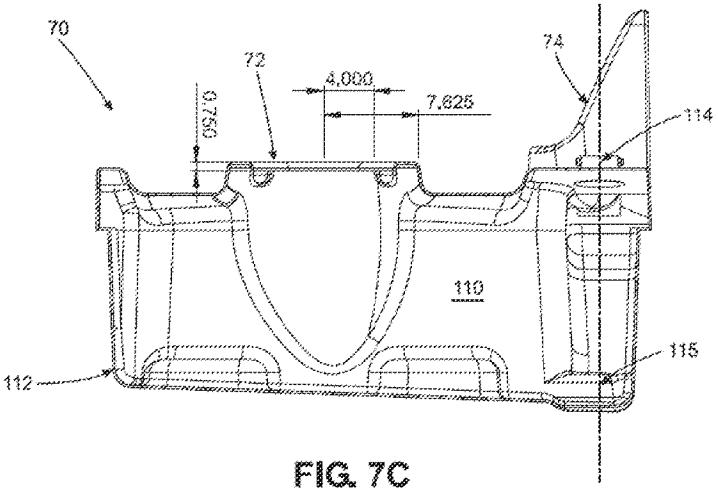

FIGS. 7A-D show views of an embodiment of the tank 70 of the portable restroom system 10 in accordance with aspects of the invention. FIG. 7A shows a perspective view of the tank 70. FIG. 7B shows a plan (top-down) view of the tank 70. FIG. 7C shows a cross-section (cutaway) view of the tank 70 along line C-C, and FIG. 7D shows a cross-section (cutaway) view of the tank 70 along line E-E.

In embodiments, the tank 70 comprises a toilet 72 with a toilet opening that leads to an interior volume 110 and a urinal 74 with a urinal opening that leads to the same interior volume 110. In embodiments, the tank 70 comprises a tank body 112 that surrounds and defines the interior volume 110. In embodiments, the tank body 112, the toilet 72, and the urinal 74 are a unitary structure, for example formed by molding. In embodiments, the tank 70 for each room is self-contained, and the respective interior volumes of the tanks of different rooms are not connected.

According to aspects of the invention, the tank body 112 includes a cleaning port 114 that extends through a wall of the tank body 112 and communicates with the interior volume 110. In embodiments, the cleaning port 114 is at an upper surface of the tank body 112 between the toilet 72 and the urinal 74. In embodiments, as shown in FIGS. 7C and 7D, the tank body 112 is configured to urge waste contained in the interior volume 110 to a location 115 that is vertically aligned with and under the cleaning port 114. For example, the bottom surface of the tank body that defines the interior volume 110 is sloped from high to low toward the location 115 when viewed in the direction shown in FIG. 7C and also when viewed in the direction shown in FIG. 7D. In this manner, waste that is in the interior volume 110 will collect at the location 115 by gravity.

In implementations, the cleaning port 114 provides a great advantage in cleaning the tank 70 compared to conventional port-a-johns. The industry standard way to clean a conventional port-a-john is to alternately spray into and around the toilet with a water hose and then apply suction through the same opening in the toilet to extract waste from inside the holding tank. Because there is only one hole of sufficient size to access the interior of the holding tank in conventional port-a-john (i.e., the hole of the toilet), this process of alternating between spraying and suctioning is necessary to adequately clean the tank. Contrary to this tedious process for conventional port-a-johns, embodiments of the invention permit a single person to simultaneously apply both spraying and suctioning when cleaning the tank 70. In an exemplary cleaning process, the person first inserts a suction hose into the cleaning port 114. Then, while suction is being applied to the interior volume 110 by the suction hose in the cleaning port 114, the same person simultaneously sprays into and around the toilet with a water hose, preferably a high-pressure washer. In his way, one person can simultaneously apply both spraying and suctioning to clean the tank 70 of the inventive system 10. As a result, one person can clean the tank 70 of the portable restroom system 10 faster and more effectively than they can clean a conventional port-a-john.

Furthermore, cleaning of the tank 70 is further enhanced by the tank body 112 being configured to urge waste toward the location 115 that is vertically aligned with and under the cleaning port 114. Because of this design, cleaning water that is being sprayed into the toilet 72 and urinal 74 moves all the waste toward the location 115 for suction by a suction hose that is inserted through the cleaning port 114, which reduces the amount of cleaning effort because the person does not need to move the suction hose around within the tank body 112 to reach all the corners of the interior volume 110.

In embodiments, the cleaning port 114 comprises a through hole having an inside diameter of greater than or equal to 3.0 inches. In this manner, the cleaning port 114 is sized to accommodate a suction hose of sufficient diameter to extend into the tank 70 to quickly remove waste therein.

According to aspects of the invention, the tank body 112 includes a first vent hole 116 and a second vent hole 118, each of which extends through a wall of the tank body 112 and communicates with the interior volume 110. In embodiments, the vent holes 116, 118 are at an upper surface of the tank body 112 and at back corners of the tank body 112. In this manner, when a tank 70 is arranged in one of the rooms 61-64 as shown in FIG. 5, one of the vent holes 116 or 118 is located inside the chase 80. The one of the vent holes that is inside the chase 80 is connected to one of the vent tubes 30, which extends from the one of the vent holes, through the roof 12, and outside the portable restroom system 10, thereby venting the interior volume 110 of the tank 70. The other one of the vent holes 116 or 118 may be capped and covered by a portion of one of the exterior wall panels 16. For example, in the configuration shown in FIG. 5, the tank 70 in room 61 has vent hole 116 in the chase 80 and vent hole 118 covered by a portion of one of the exterior wall panels 16. Conversely, the tank 70 in room 62 has vent hole 118 in the chase 80 and vent hole 116 covered by a portion of one of the exterior wall panels 16. The flexibility provided by the two vent holes 116 and 118, one of which will be located within the chase 80, permits using identical tanks 70 in each room 61-64, which reduces manufacturing complexity and cost.

Another advantage provided by the unitary design of the tank body 112 is that there is a relatively large cross-sectional area in the passage that connects the urinal 74 to the interior volume 110. Conventional port-a-johns connect the urinal to a holding tank under the toilet using a hose and clamps, the hose typically being the size of a standard garden hose (i.e., about ⅝ inch diameter). This small diameter hose in conventional port-a-johns often becomes clogged when people drop items (e.g., toilet paper, food wrappers, cigarette butts) into the urinal. Contrary to this clog-prone design of conventional port-a-johns, embodiments of the invention have the urinal 74 and the toilet 72 formed as part of the unitary tank body 112 that has a larger area passage extending the entire way between the urinal 74 and the interior volume 110. In embodiments, this passage has a smallest crosswise dimension that is greater than or equal to 3.0 inches. In this manner, the tank 70 is less likely to get clogged by items that are dropped in the urinal 74.

Figure 8A:
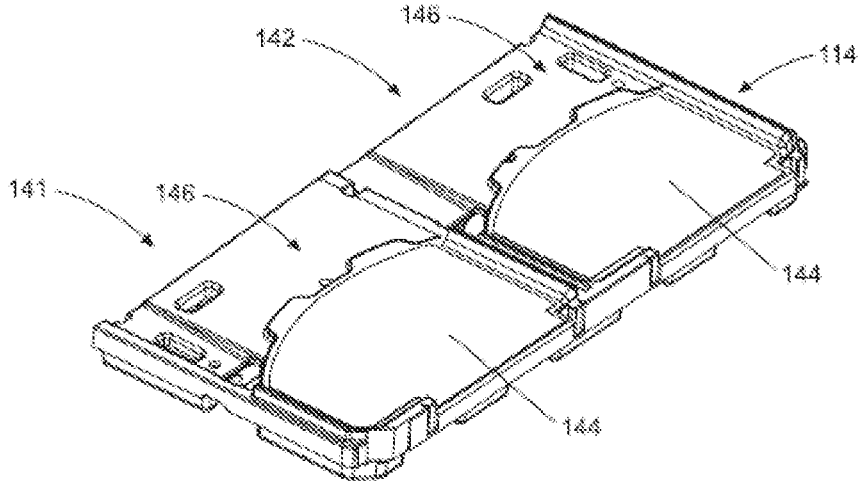
FIGS. 8A-C show views of a floor element of the portable restroom system in accordance with aspects of the invention.
Figure 8B:
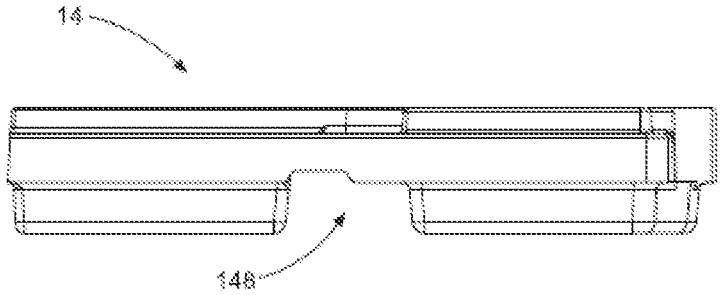
Figure 8C:
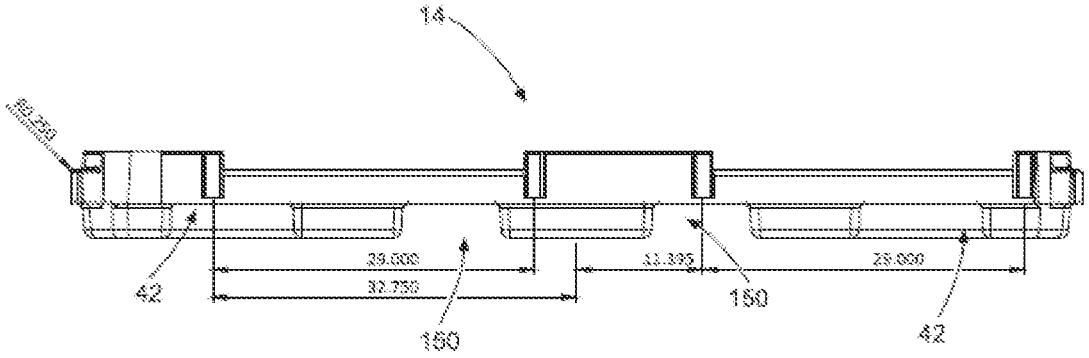

FIGS. 8A-C show views of a floor element 14 of the portable restroom system 10 in accordance with aspects of the invention. A respective instance of the floor element 14 may be used for each of the floor elements 14*a* and 14*b*. FIG. 8A shows a perspective view of the floor element 14. FIG. 8B shows a left side view of the floor element 14. FIG. 8C shows a front side view of the floor element 14.

In embodiments, the top side of the floor element 14 has two side-by-side areas 141 and 142 that are in different rooms in the portable restroom system 10. Each area 141, 142 has a textured surface area 144 designed for a user to stand on, and a tank surface 146 on which the tank 70 sits. In embodiments, as shown in FIG. 8B, the bottom side of the floor element 14 has a channel 148 that accommodates one of the skid rails 34. In embodiments, as shown in FIG. 8C, the bottom side of the floor element 14 has a two channels 150 that accommodate the fork tubes 32, and two openings 42 that expose the anchor structures 38 (as described with respect to FIGS. 3 and 4)

Figure 9:
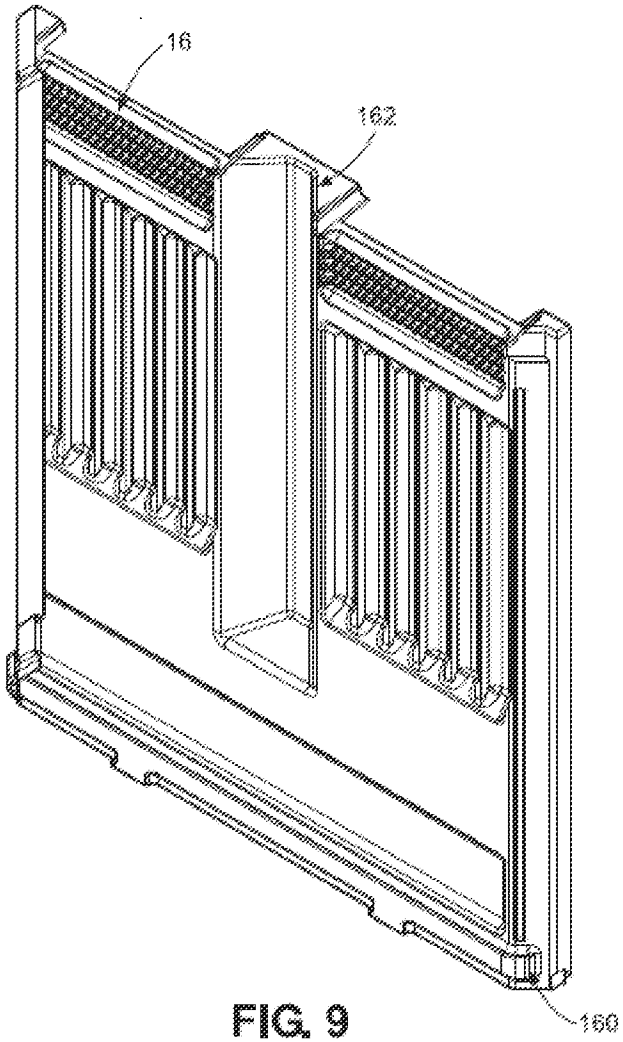
FIG. 9 shows a side wall element of the portable restroom system in accordance with aspects of the invention.

FIG. 9 shows a side wall element 16 of the portable restroom system 10 in accordance with aspects of the invention. In embodiments, the side wall element 16 comprises a first shaped feature 160 that corresponds to the size and shape of the side edge of the floor element 14, such that the side edge of the floor element 14 is retained in the first shaped feature 160 when the portable restroom system 10 is assembled. In this manner, the interaction between the first shaped feature 160 and the side edge of the floor elements 14 helps properly locate the floor elements 14 during manufacture, and helps hold the portable restroom system 10 together after manufacture. In a preferred embodiment, the side edge of the floor element 14 is snap fit or friction fit into the first shaped feature 160, and this connection may be reinforced by adhesive and/or mechanical fastener.

Figure 10:
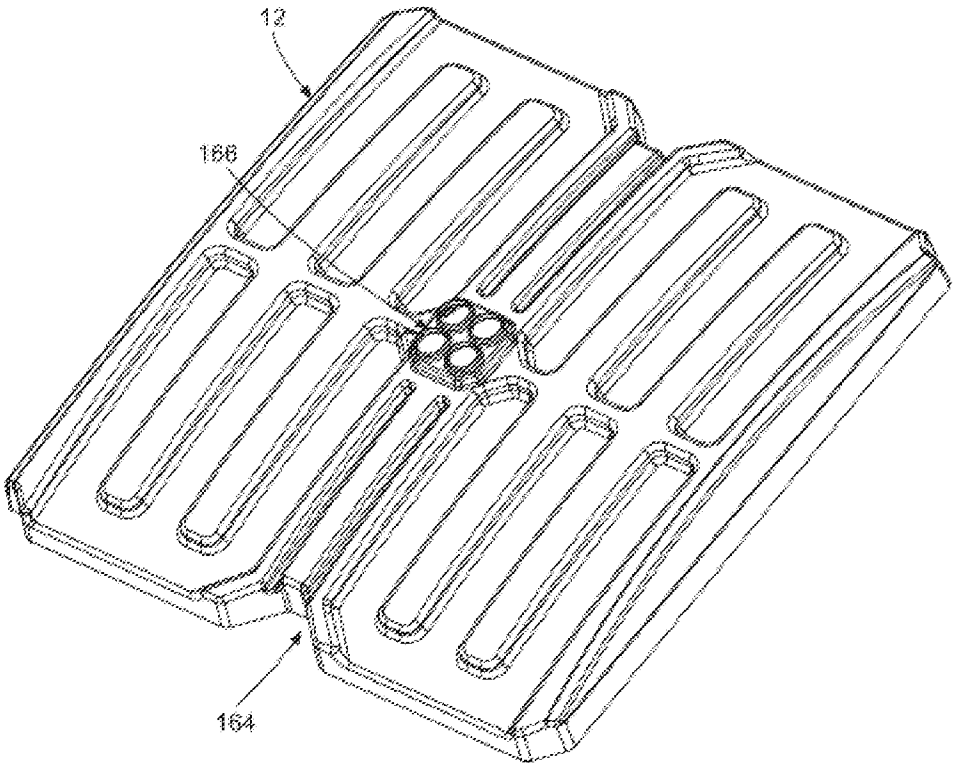
FIG. 10 shows a top element of the portable restroom system in accordance with aspects of the invention.

Referring now to FIGS. 9 and 10, in embodiments the side wall element 16 comprises a second shaped feature 162 (shown in FIG. 9) that corresponds to the size and shape of a shaped feature 164 of the roof 12 (shown in FIG. 10). In embodiments, the second shaped feature 162 is retained in the shaped feature of the roof 12 when the portable restroom system 10 is assembled. In this manner, the interaction between the second shaped feature 162 and the shaped feature 164 of the roof 12 helps properly locate the side wall elements 16 relative to the roof 12 during manufacture, and helps hold the portable restroom system 10 together after manufacture. In a preferred embodiment, the second shaped feature 162 is snap fit or friction fit into the shaped feature 164 of the roof 12, and this connection may be reinforced by adhesive and/or mechanical fastener.

As also shown in FIG. 10, the roof 12 may include four holes 166 that accommodate the four vent tubes 30, respectively.

Figure 11B:
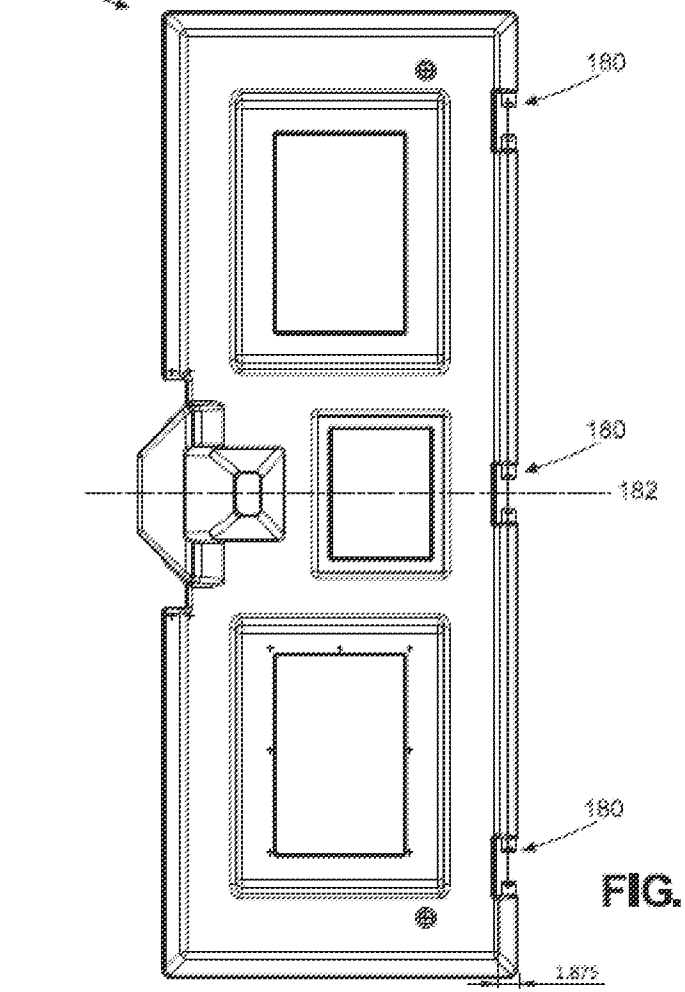
FIGS. 11A and 11B show views a door of the portable restroom system in accordance with aspects of the invention.
Figure 11A:
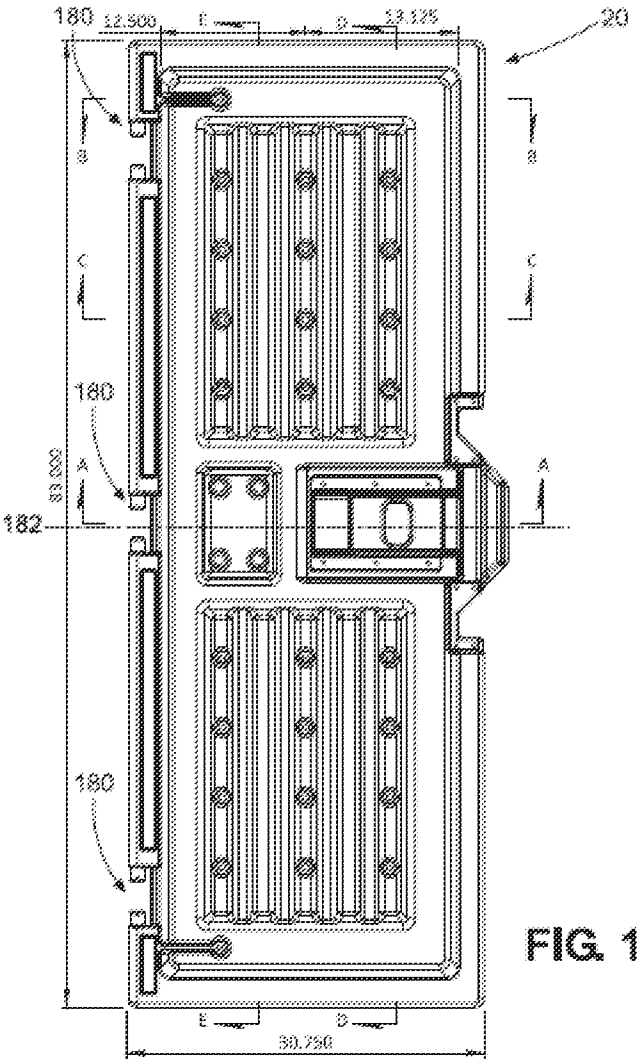

FIGS. 11A and 11B show views a door 20 of the portable restroom system 10 in accordance with aspects of the invention. FIG. 11A shows the interior side of the door 20, and FIG. 11B shows the exterior side of the door 20. As shown in FIGS. 11A and 11B, the door includes hinge connections 180. In embodiments, the door 20 is symmetric about horizontal axis 182. In this manner, identical instances of the door may be used on both sides 21, 22 of the portable restroom system 10, by flipping the doors 20 on one side relative to those on the other side to achieve the opposite swing directions described at FIG. 5.

In accordance with aspects of the invention, each door 20 includes a door locking structure that permits locking the door 20 relative to the pod. The door locking structure may be a part of a hasp that engages another part of the hasp on the pod, such that a padlock or combination lock may be used with the hasp to lock the door 20 relative to the pod. Implementations are not limited to using a hasp, and other locking structures may be used.

According to an exemplary method of use, an owner (or lessor) of the portable restroom system 10 rents or leases the portable restroom system 10 to a customer for a rental period of time. Typical rental periods are measured in weekly or monthly increments. Prior to delivering the portable restroom system 10 to a rental site specified by the customer, the owner (or an employee of the owner) cleans all four rooms 61-64 of the pod structure, e.g., using the simultaneous suction and pressure washing described herein. The owner thus delivers the portable restroom system 10 to the customer with all four rooms 61-64 in pristine, clean condition. Upon delivery, the customer inspects all four rooms 61-64 for cleanliness, and then locks the door of each of three rooms (e.g., rooms 62, 63, 64), leaving the door of one room (e.g., room 61) unlocked. This one unlocked room will be the room that is in service for a first time period of the rental period (e.g., a first week of the month). After the first time period ends (e.g., at the end of the first week), the customer unlocks the second room (e.g., room 62) and places that lock on the first room (e.g., room 61) that was just in service. In this manner, the customer takes the first room out of service and places the second room in service. The customer knows that the second room is in pristine, clean condition because the second room has not yet been used since the pod was dropped off and inspected. The customer continues taking a used room out of service and placing a new room in service at regular intervals (e.g., each week) or as needed. In this manner, owner does not need to do an on-site service trip for cleaning at the end of each week, which advantageously reduces the operational cost of the owner. Also, because each newly opened room is in pristine, clean condition when the customer changes the lock, the customer is happy and has no reason to complain about lack of cleaning. In this manner, the portable restroom system 10 proves a vast improvement over the practice of dropping off a single port-a-john at the beginning of the month and cleaning the port-a-john on-site on a weekly basis, the improvement benefiting both the owner and the customer.

In embodiments, the roof 12, floor elements 14, exterior wall panels 16, interior wall panels, doors 20, and tanks 70 are composed of plastic material. The plastic material may include additives such as one or more of antimicrobial, antifungal, antibacterial, and odor prevention additives. Different elements may be composed of different plastics. Different elements may be formed using different techniques, such as rotation molding, injection molding, thermoforming, etc. Additional aspects of the invention include manufacturing one or more parts of the portable restroom system 10. Additional aspects of the invention include assembling the portable restroom system 10.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A portable restroom system, comprising:

plural individual restrooms connected as a pod structure and supported by a chassis, wherein each restroom comprises:

a lockable door that opens to outside the pod structure;

a tank having a toilet with a toilet opening, a urinal with a urinal opening, a cleaning port, and two vent holes, all as part of a molded unitary tank body that defines an interior volume;

a chase extending vertically in the pod structure; and plural vent tubes comprising a respective vent tube connected to each respective tank extending through the chase.

2. The portable restroom system of claim 1, wherein:

the cleaning port is at a top surface of the tank body between the toilet and the urinal; and a bottom, interior surface of the tank body is sloped toward a location that is vertically aligned with and underneath the cleaning port.

3. The portable restroom system of claim 2, wherein the cleaning port has an inside diameter that is greater than or equal to 3.0 inches.

4. The portable restroom system of claim 1, wherein the chassis is at a bottom of the pod structure and comprises:

fork tubes configured to receive forks of a forklift; and skid rails configured for skidding the pod structure.

5. The portable restroom system of claim 4, wherein the fork tubes extend perpendicular to the skid rails.

6. The portable restroom system of claim 4, wherein:

the fork tubes extend from a first side of the pod structure to a second side of the pod structure; and the skid rails extend from a third side of the pod structure to a fourth side of the pod structure.

7. The portable restroom system of claim 1, wherein the plural individual restrooms consist of four rooms arranged in a square-like shape of the pod structure when viewed from a top-down view.

8. The portable restroom system of claim 1, further comprising a roof that covers each of the four rooms and the chase, the roof comprising plural holes through which the plural vent tubes extend to outside the pod structure.

9. The portable restroom system of claim 1, wherein:

the two vent holes of each tank comprise a first vent hole at a first corner of the tank and a second vent hole at a second corner of the tank;

two of the tanks in a two of the four rooms have their first vent hole connected to respective ones of the vent tubes in the chase; and two other ones of the tanks in two other ones of the four rooms have their second vent hole connected to respective ones of the vent tubes in the chase.

10. The portable restroom system of claim 1, wherein the chase is defined by portions of interior walls that separate the four rooms.

11. The portable restroom system of claim 10, wherein:

each of the portions of the interior walls comprises a respective communication port;

each said respective communication port provides a respective communication path between a respective one of the rooms and an interior volume defined by the chase; and the respective communication paths are configured to communicate music and/or conditioned air from one of the four rooms to other ones of the four rooms.

12. The portable restroom system of claim 7, wherein:

two of the four rooms have their door on a first side of the pod structure; and two other ones of the four rooms have their door on a second side of the pod structure.

13. The portable restroom system of claim 12, wherein:

the doors of all four rooms are identical in shape;

the doors of the two of the four rooms open outward with a right-hand swing; and the doors of the two other ones of the four rooms open outward with a left-hand swing.

14. The portable restroom system of claim 12, further comprising:

a first floor element that defines a floor of the two of the four rooms; and a second floor element that defines a floor of the two other ones of the four rooms.

15. The portable restroom system of claim 14, wherein the chassis connects the first floor element and the second floor element.

16. The portable restroom system of claim 15, further comprising:

a first external wall on a third side of the pod structure;

a second external wall on a fourth side of the pod structure; and a single roof connected to each of the first external wall and the second external wall, wherein the single roof covers the four rooms.

17. The portable restroom system of claim 1, wherein the pod structure is devoid of wheels for movement.

18. The portable restroom system of claim 1, wherein the pod structure is devoid of water pumps.

19. A portable restroom system, comprising:

a pod structure comprising four restrooms supported by a chassis; and a chase extending vertically in the pod structure between the four restrooms, wherein each restroom comprises:

a lockable door that opens to outside the pod structure; and a tank having a unitary tank body that defines an interior volume, a toilet that opens to the interior volume, a urinal that opens to the interior volume, a cleaning port that opens to the interior volume, and at least one vent hole that opens to the interior volume and that is in the chase.

20. The portable restroom system of claim 19, wherein:

for each respective tank, the cleaning port is at a top surface of the tank body between the toilet and the urinal;

for each respective tank, a bottom, interior surface of the tank body is sloped toward a location that is vertically aligned with and underneath the cleaning port;

the chassis is at a bottom of the pod structure;

the chassis comprises fork tubes configured to receive forks of a forklift; and the chassis comprises skid rails configured for skidding the pod structure such that the pod structure is devoid of wheels for movement.

* * * * *